US010006463B2

(12) United States Patent
Kashihara et al.

(10) Patent No.: US 10,006,463 B2
(45) Date of Patent: Jun. 26, 2018

(54) AIR CONDITIONING APPARATUS

(71) Applicant: DAIKIN INDUSTRIES, LTD., Osaka-shi, Osaka (JP)

(72) Inventors: Takashi Kashihara, Sakai (JP); Takahiro Yamasaki, Sakai (JP); Naofumi Yokoyama, Sakai (JP); Tsuyoshi Yokomizo, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 495 days.

(21) Appl. No.: 14/687,216

(22) Filed: Apr. 15, 2015

(65) Prior Publication Data

US 2015/0300359 A1 Oct. 22, 2015

(30) Foreign Application Priority Data

Apr. 18, 2014 (JP) ..... 2014-086211
Feb. 18, 2015 (JP) ..... 2015-029635

(51) Int. Cl.

| | |
|---|---|
| ***F24F 7/06*** | (2006.01) |
| ***F24F 7/007*** | (2006.01) |
| ***F04D 17/08*** | (2006.01) |
| ***F04D 27/00*** | (2006.01) |
| ***F24F 1/50*** | (2011.01) |
| ***F24F 11/89*** | (2018.01) |

(52) U.S. Cl.

CPC ..... *F04D 17/08* (2013.01); *F04D 27/001* (2013.01); *F24F 1/50* (2013.01); *F24F 11/89* (2018.01)

(58) Field of Classification Search

CPC ... F24F 1/50; F24F 11/02; F24F 11/89; F04D 17/08; F04D 27/001

See application file for complete search history.

(56) References Cited

U.S. PATENT DOCUMENTS 5,586,861 A * 12/1996 Berger ..... F04D 27/00 415/118
5,682,754 A * 11/1997 Groenewold ..... F24F 5/0071 236/49.3
6,186,744 B1 * 2/2001 Wolochuk ..... F04D 27/001 417/44.2

(Continued)

FOREIGN PATENT DOCUMENTS

JP 6-281194 A 10/1994
JP 06281194 A * 10/1994
JP 2010-31680 A 2/2010

*Primary Examiner* — Steven B McAllister
*Assistant Examiner* — Jonathan Cotov
(74) *Attorney, Agent, or Firm* — Global IP Counselors, LLP

(57) ABSTRACT

An air conditioning apparatus includes a centrifugal fan mounted in an interior of a casing and a pressure sensor. The pressure sensor can have a primary-side pressure detection tube opened in a position adjacent to a circumferential part of the casing on an inlet side surface of the bell mouth of the fan when the bell mouth is seen from a direction along the rotary shaft to detect a primary-side pressure of the centrifugal fan. Alternatively, the pressure sensor can have a primary-side pressure detection tube opened in a position adjacent to a circumferential part of the casing on a heat exchanger compartment side surface of the partition member when the partition member is seen from a direction along the rotary shaft to detect a primary-side pressure of the centrifugal fan.

10 Claims, 14 Drawing Sheets

(56) References Cited

U.S. PATENT DOCUMENTS

| | | | | |
|---|---|---|---|---|
| 8,070,423 | B2 * | 12/2011 | Vogel | F04D 27/006 415/118 |
| 8,366,377 | B2 * | 2/2013 | Smiley, III | F04D 27/001 415/1 |
| 9,176,023 | B2 * | 11/2015 | Reunanen | F04D 13/06 |
| 2004/0251344 | A1 * | 12/2004 | Lutton | G01F 1/363 241/47 |
| 2008/0156887 | A1 * | 7/2008 | Stanimirovic | F24F 11/0086 236/12.1 |
| 2012/0285262 | A1 * | 11/2012 | Kelley | G01F 1/40 73/861.42 |
| 2014/0096547 | A1 * | 4/2014 | Boehde | F04D 27/004 62/89 |

* cited by examiner

AIR CONDITIONING APPARATUS

CROSS-REFERENCE TO RELATED APPLICATIONS

This application claims priority under 35 U.S.C. § 119 to Japanese Patent Application Nos. 2014-086211 and 2015-029635, filed Apr. 18, 2014 and Feb. 18, 2015, respectively. The entire disclosures of Japanese Patent Application Nos. 2014-086211 and 2015-029635 are hereby incorporated herein by reference.

FIELD OF THE INVENTION

The present invention relates to an air conditioning apparatus, particularly to an air conditioning apparatus that a centrifugal fan is mounted inside a casing.

BACKGROUND INFORMATION

As described in Japan Laid-open Patent Application Publication No. H06-281194, an air conditioning apparatus has been produced so far that a rearward bladed centrifugal fan is mounted in a ventilation unit (a fan compartment) having a fan entrance bored in opposition to a blow-out port such that a rotary shaft of the centrifugal fan is oriented to an opening direction of the fan entrance. On the other hand, as described in Japan Laid-open Patent Application Publication No. 2010-31680, an air conditioning apparatus equipped with a sirocco fan (a multi-bladed fan) has been produced in which a required airflow rate is configured to be obtained on the basis of the shaft power of the sirocco fan in performing rotation speed control.

SUMMARY

It can be herein assumed to employ rotation speed control as described in Japan Laid-open Patent Application Publication No. 2010-31680 for an air conditioning apparatus equipped with a centrifugal fan as described in Japan Laid-open Patent Application Publication No. H06-281194.

However, variation in output of a fan motor is smaller in the centrifugal fan than in the sirocco fan. It is thus herein difficult to perform the rotation speed control as described in Japan Laid-open Patent Application Publication No. 2010-31680. Accordingly, the air conditioning apparatus equipped with the centrifugal fan as described in Japan Laid-open Patent Application Publication No. H06-281194 is required to detect a primary-side pressure and a secondary-side pressure of the centrifugal fan with use of a pressure sensor and perform rotation speed control on the basis of the detected pressures. Furthermore, to meet the requirement, it is indispensable to accurately detect the primary-side pressure of the centrifugal fan.

It is an object of the present invention to enable accurate detection of a primary-side pressure of a centrifugal fan in an air conditioning apparatus that a centrifugal fan is mounted inside a casing.

An air conditioning apparatus according to a first aspect is equipped with a centrifugal fan mounted in an interior of a casing. The centrifugal fan includes a bladed wheel and a bell mouth. The bladed wheel is composed of a hub, a shroud and a plurality of rearward blades. The hub is coupled to a rotary shaft of a fan motor. The shroud is opposed to the hub and has a fan opening bored in a center part thereof. The rearward blades are disposed between an outer peripheral part of the hub and an outer peripheral part of the shroud. The bell mouth is inserted at an outlet end thereof into the fan entrance. Furthermore, a primary-side pressure detection tube of a pressure sensor for detecting a primary-side pressure of the centrifugal fan is opened in a position close to a circumferential part of the casing on an inlet side surface of the bell mouth when the bell mouth is seen from a direction along the rotary shaft.

As described above, the primary-side pressure detection tube of the pressure sensor for detecting the primary-side pressure of the centrifugal fan is herein designed to be opened in the position close to the circumferential part of the casing on the inlet side surface of the bell mouth. With the construction, the primary-side pressure detection tube is herein opened in a position unlikely to be affected by dynamic pressure in the vicinity of the fan opening on the inlet side surface of the bell mouth.

Consequently, the primary-side pressure of the centrifugal fan can be herein accurately detected.

An air conditioning apparatus according to a second aspect includes a casing, a partition member, a heat exchanger and a centrifugal fan. The casing has an intake port and a blow-out port. The partition member divides an interior of the casing into a heat exchanger compartment located on an intake port side and a fan compartment located on a blow-out port side, and has a fan entrance that makes the heat exchanger compartment and the fan compartment communicate with each other. The heat exchanger is mounted in the heat exchanger compartment. The centrifugal fan includes a bladed wheel having a plurality of rearward blades and is configured to suck air existing in the heat exchanger compartment into the fan compartment through the fan entrance, with the bladed wheel being mounted in the fan compartment such that a rotary shaft of the bladed wheel is oriented to an opening direction of the fan entrance. Furthermore, a primary-side pressure detection tube of a pressure sensor for detecting a primary-side pressure of the centrifugal fan is opened in a position close to a circumferential part of the casing on a heat exchanger compartment side surface of the partition member when the partition member is seen from a direction along the rotary shaft.

As described above, the primary-side pressure detection tube of the pressure sensor for detecting the primary-side pressure of the centrifugal fan is herein designed to be opened in the position close to the circumferential part of the casing on the heat exchanger compartment side surface of the partition member having the fan entrance. With the construction, the primary-side pressure detection tube is herein opened in a position unlikely to be affected by dynamic pressure in the vicinity of the fan entrance on the heat exchanger compartment side surface of the partition member.

Consequently, the primary-side pressure of the centrifugal fan can be herein accurately detected.

An air conditioning apparatus according to a third aspect relates to the air conditioning apparatus according to the first or second aspect, and wherein the primary-side pressure detection tube is opened in a position close to a corner of the circumferential part of the casing when seen from the direction along the rotary shaft.

As described above, the primary-side pressure detection tube is herein designed to be opened in the position close to the corner of the circumferential part of the casing. With the construction, the primary-side pressure detection tube is herein opened in a position more unlikely to be affected by dynamic pressure in the vicinity of the fan opening (the fan entrance) on the inlet side surface of the bell mouth (i.e., the heat exchanger compartment side surface of the partition member).

Consequently, the primary-side pressure of the centrifugal fan can be herein more accurately detected.

An air conditioning apparatus according to a fourth aspect relates to the air conditioning apparatus according to the second aspect, and wherein the pressure sensor is disposed on a fan compartment side of the partition member. Furthermore, the primary-side pressure detection tube extends from the pressure sensor to the partition member along lateral parts forming the circumferential part of the casing when seen from the direction along the rotary shaft.

As described above, when constructed to extend to the partition member from the pressure sensor disposed on the fan compartment side, the primary-side pressure detection tube is herein designed to extend along the lateral parts composing the circumferential part of the casing. With the construction, the primary-side pressure detection tube can be disposed in a position that the flow of air blown out by the centrifugal fan is unlikely to be blocked by the primary-side pressure detection tube.

Consequently, degradation in ventilation performance of the centrifugal fan can be herein inhibited as much as possible, and simultaneously, the primary-side pressure detection tube can be constructed to extend to the partition member from the pressure sensor disposed on the fan compartment side.

An air conditioning apparatus according to a fifth aspect relates to the air conditioning apparatus according to the second or fourth aspect, and wherein the rotary shaft of the bladed wheel is disposed in a position close to a bladed wheel nearby lateral part, which is one of the lateral parts of the casing that are disposed along the opening direction of the fan entrance. Furthermore, the primary-side pressure detection tube is opened in a position close to another of the lateral parts of the casing, i.e., the lateral part opposed to the bladed wheel nearby lateral part.

As described above, the rotary shaft of the bladed wheel is herein designed to be disposed closely to the bladed wheel nearby lateral part, and the primary-side pressure detection tube is designed to be opened in the position close to the lateral part opposed to the bladed wheel nearby lateral part. With the construction, the primary-side pressure detection tube is herein opened in a position more unlikely to be affected by dynamic pressure in the vicinity of the fan entrance on the heat exchanger compartment side surface of the partition member.

Consequently, the primary-side pressure of the centrifugal fan can be herein more accurately detected.

An air conditioning apparatus according to a sixth aspect relates to the air conditioning apparatus according to any of the second, fourth and fifth aspects, and wherein a secondary-side pressure detection tube of a pressure sensor for detecting a secondary-side pressure of the centrifugal fan is opened in the fan compartment. The air conditioning apparatus is configured to perform rotation speed control of the centrifugal fan based on a pressure differential between the secondary-side pressure and the primary-side pressure.

As described above, the rotation speed control of the centrifugal fan is herein configured to be performed based on the pressure differential between the secondary-side pressure and the primary-side pressure. With the construction, the rotation speed control of the centrifugal fan can be herein performed based on the primary-side pressure detected by the primary-side pressure detection tube opened in a position unlikely to be affected by dynamic pressure in the vicinity of the fan entrance.

Consequently, the rotation speed control of the centrifugal fan can be herein accurately performed.

BRIEF DESCRIPTION OF THE DRAWINGS

Referring now to the attached drawings which form a part of this original disclosure.

DETAILED DESCRIPTION OF EMBODIMENTS

An air conditioning apparatus according to a preferred embodiment of the present invention will be hereinafter explained on the basis of the attached drawings. It should be noted that a specific construction of the air conditioning apparatus according to the present invention is not limited to the following preferred embodiment and the modifications thereof, and can be changed without departing from the scope of the present invention.

(1) Basic Construction of Air Conditioning Apparatus

Figure 1:
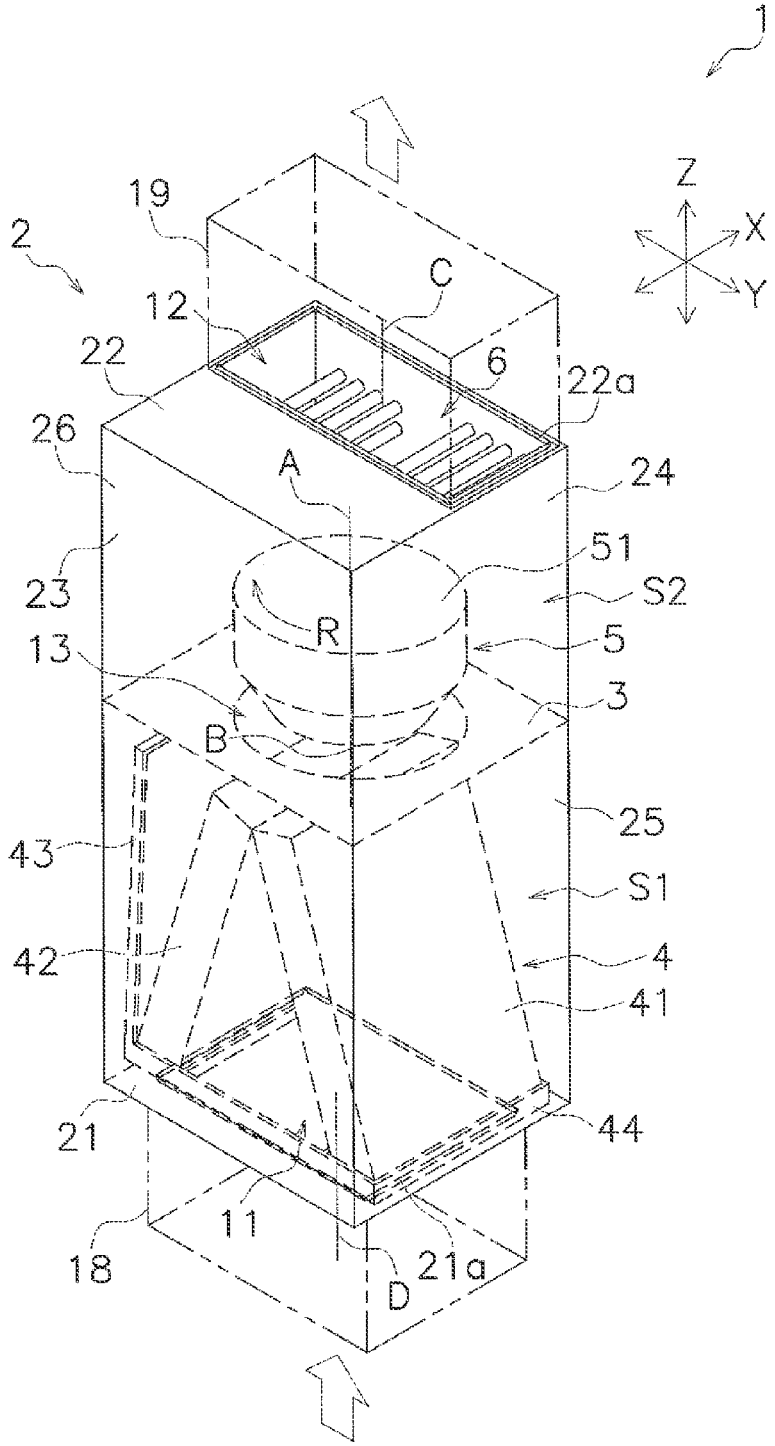
FIG. 1 is an external perspective view of an air conditioning apparatus according to a preferred embodiment of the present invention (in a vertical mount configuration)
Figure 2:
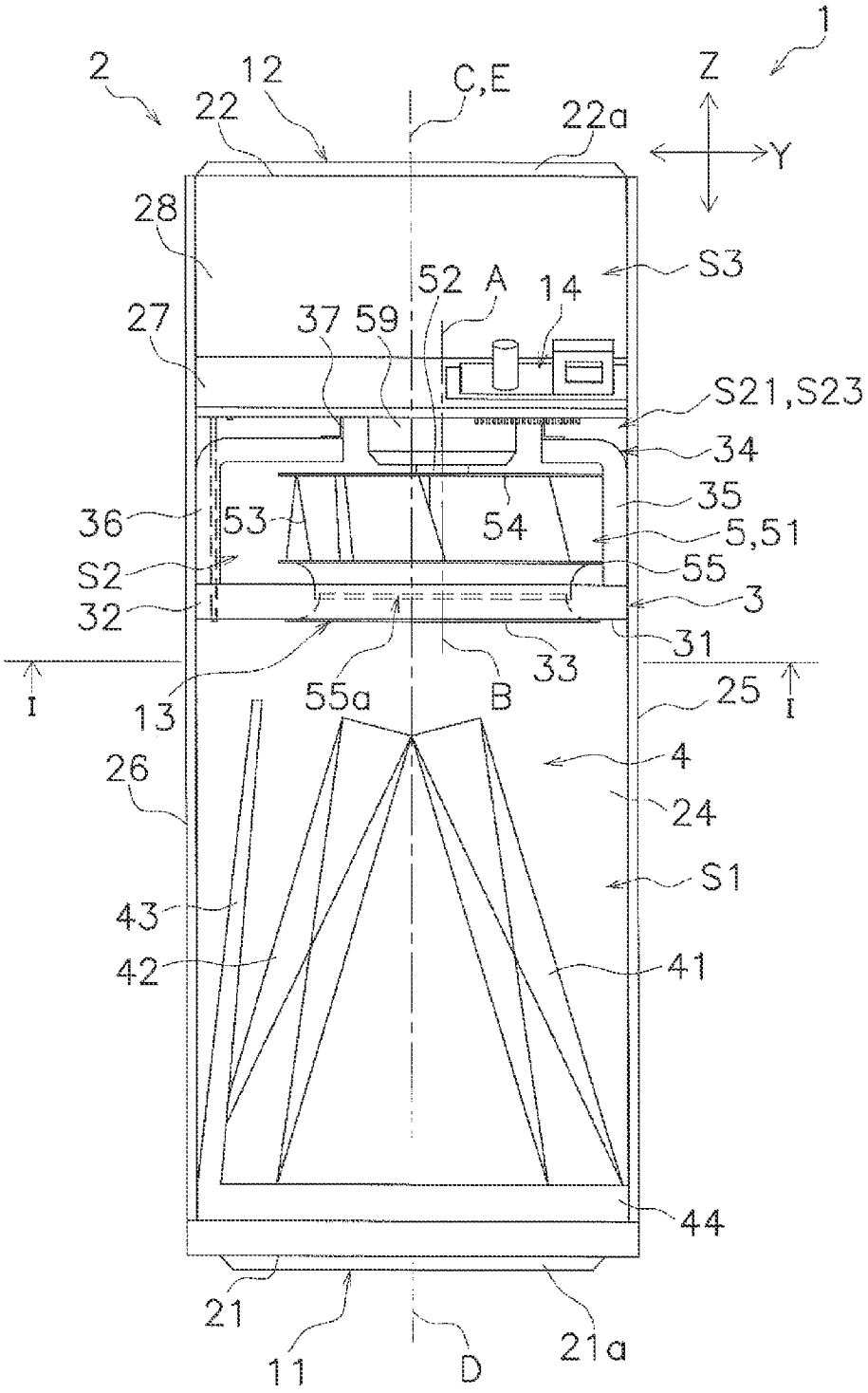
FIG. 2 is a front lateral view of the air conditioning apparatus from which a first lateral part is detached (in the vertical mount configuration)
Figure 3:
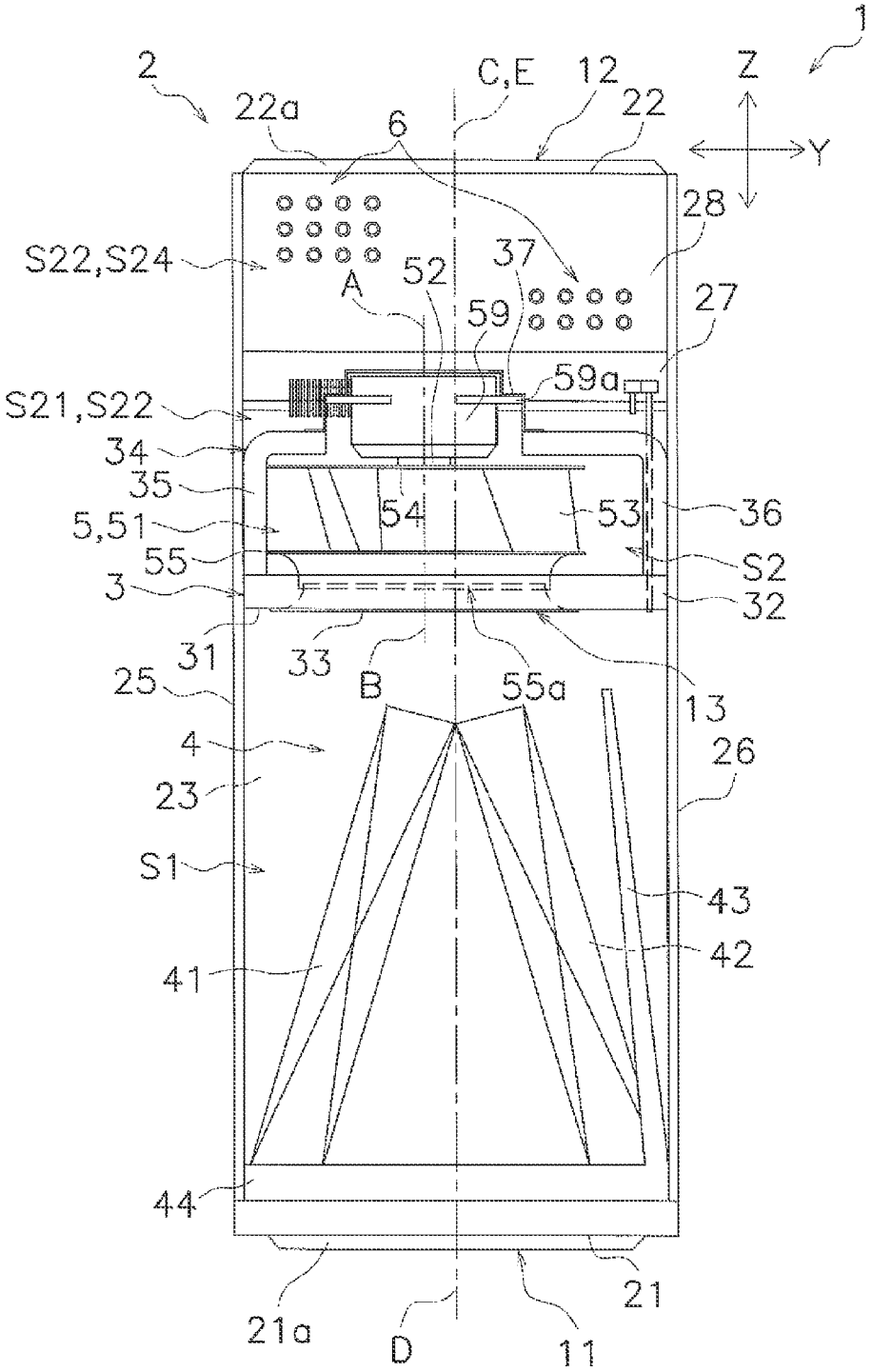
FIG. 3 is a rear lateral view of the air conditioning apparatus from which a second lateral part is detached (in the vertical mount configuration)
Figure 4:
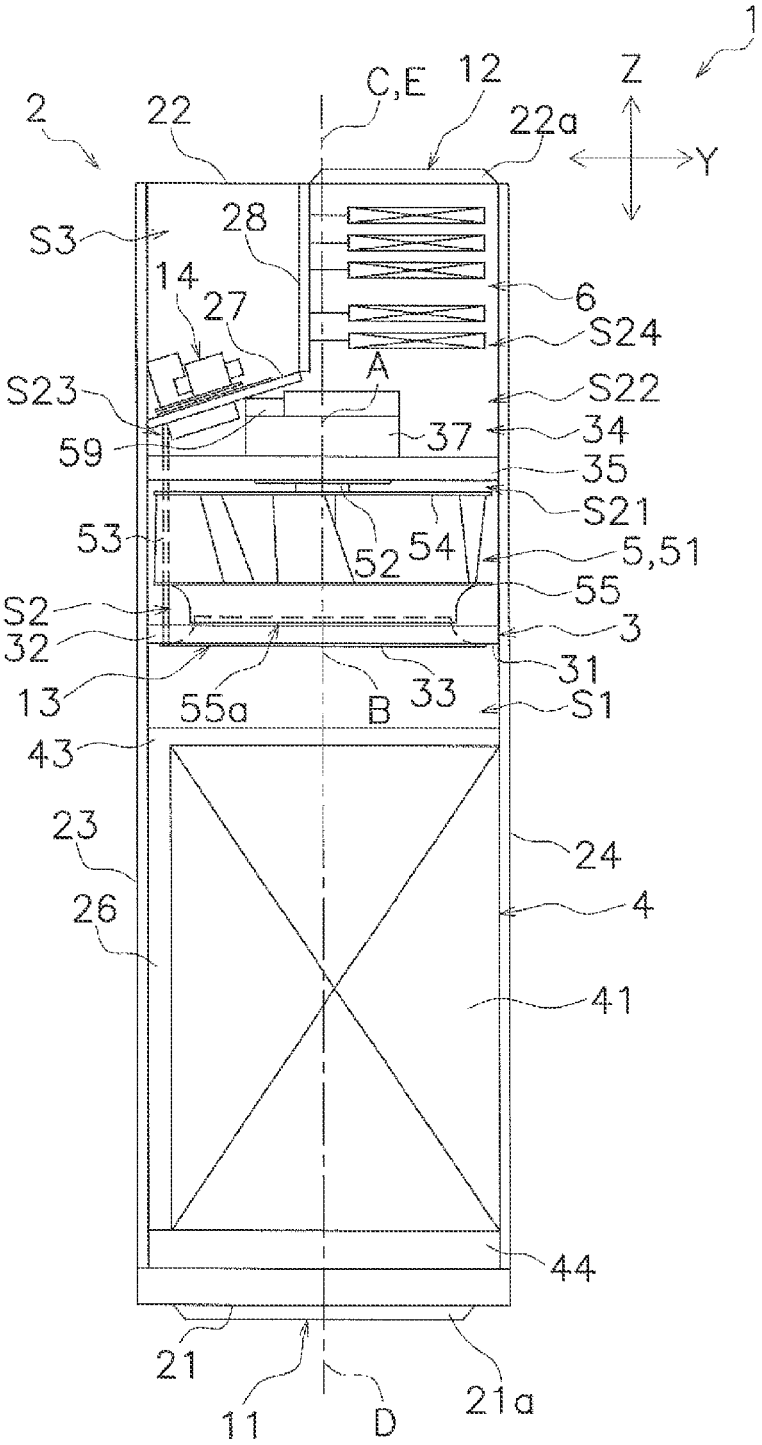
FIG. 4 is a right lateral view of the air conditioning apparatus from which a third lateral part is detached (in the vertical mount configuration)
Figure 5:
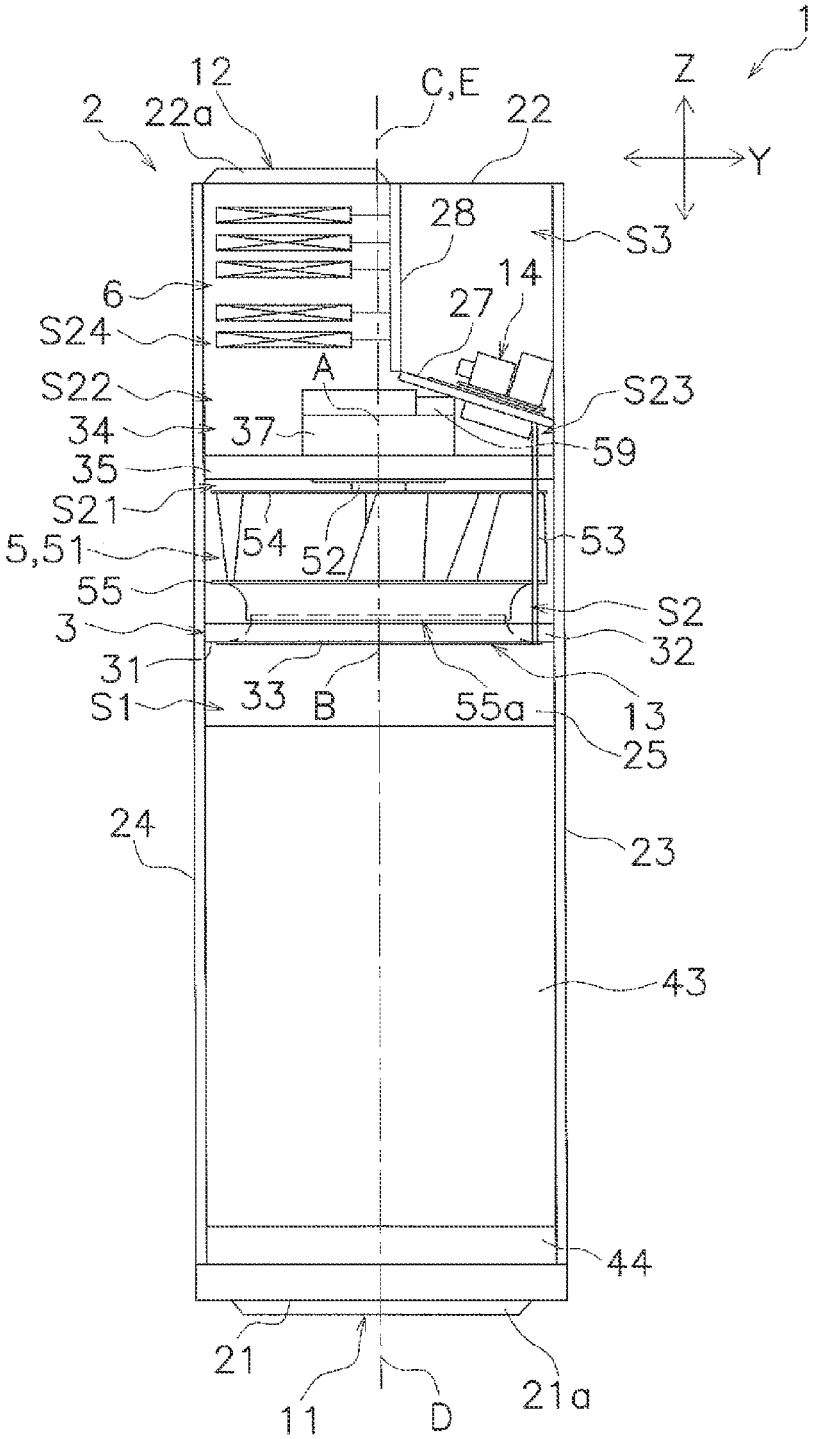
FIG. 5 is a left lateral view of the air conditioning apparatus from which a fourth lateral part is detached (in the vertical mount configuration)
Figure 6:
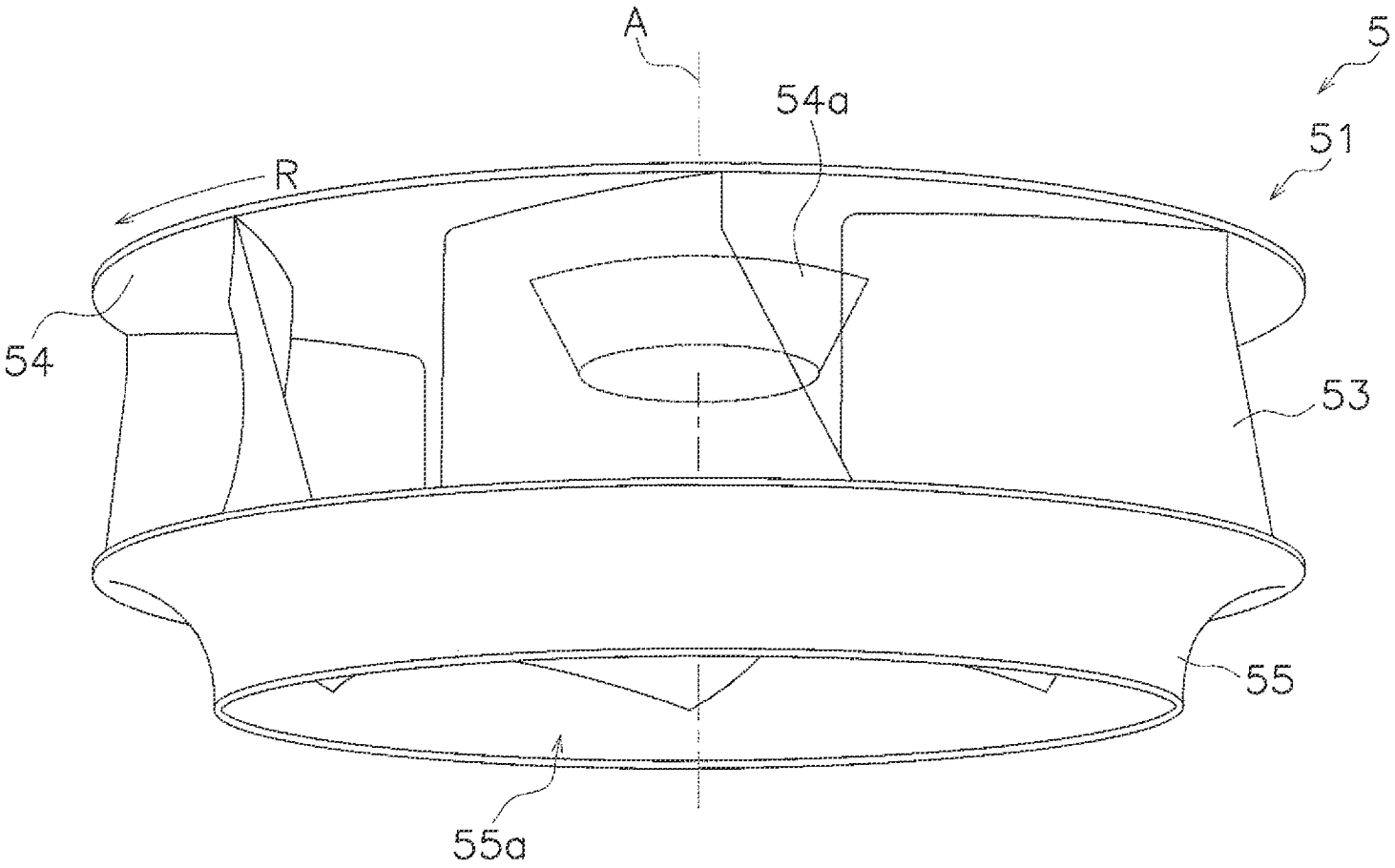
FIG. 6 is an external perspective view of a bladed wheel of a centrifugal fan.
Figure 7:
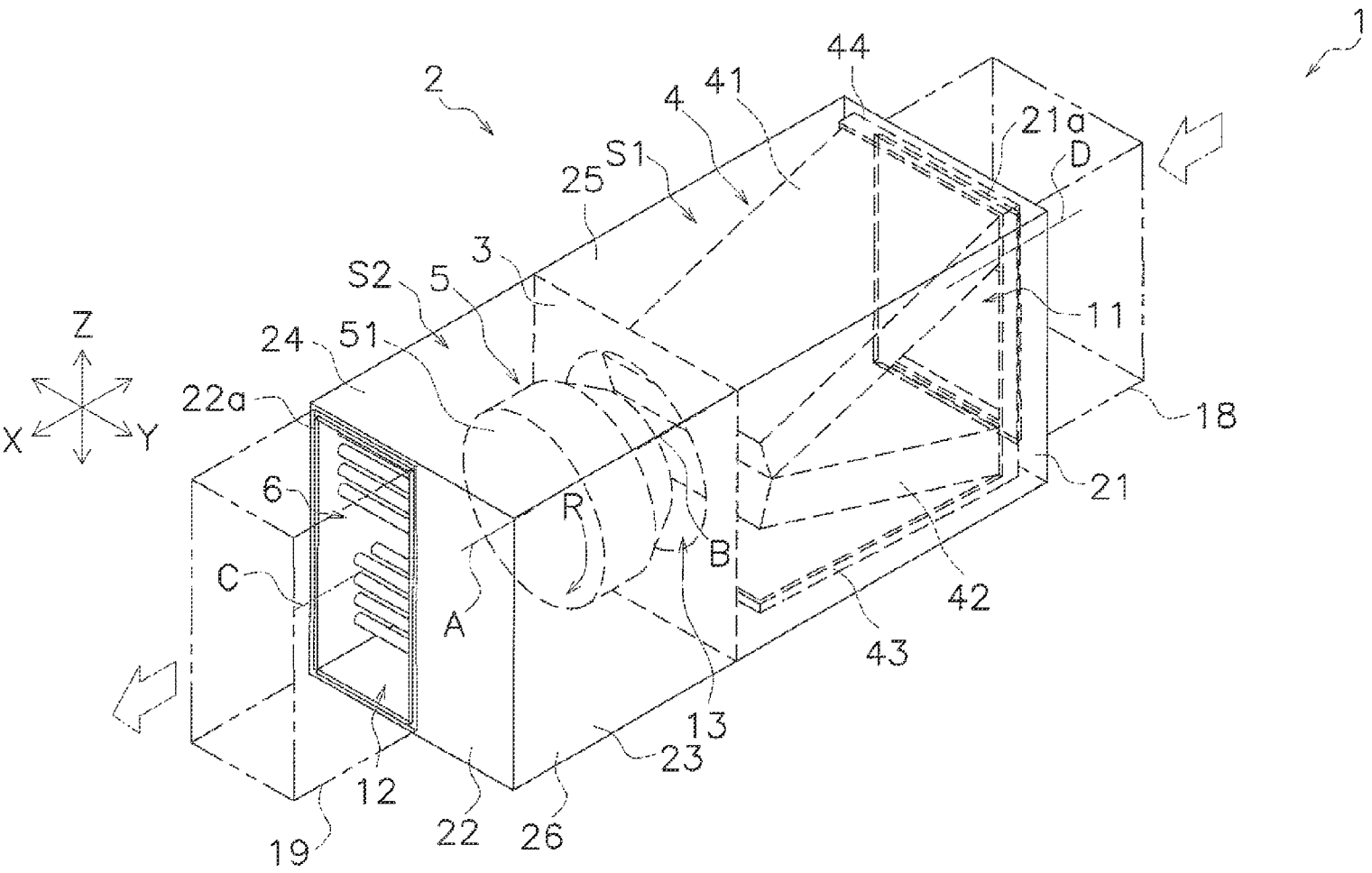
FIG. 7 is an external perspective view of the air conditioning apparatus (in a horizontal mount configuration)
Figure 8:
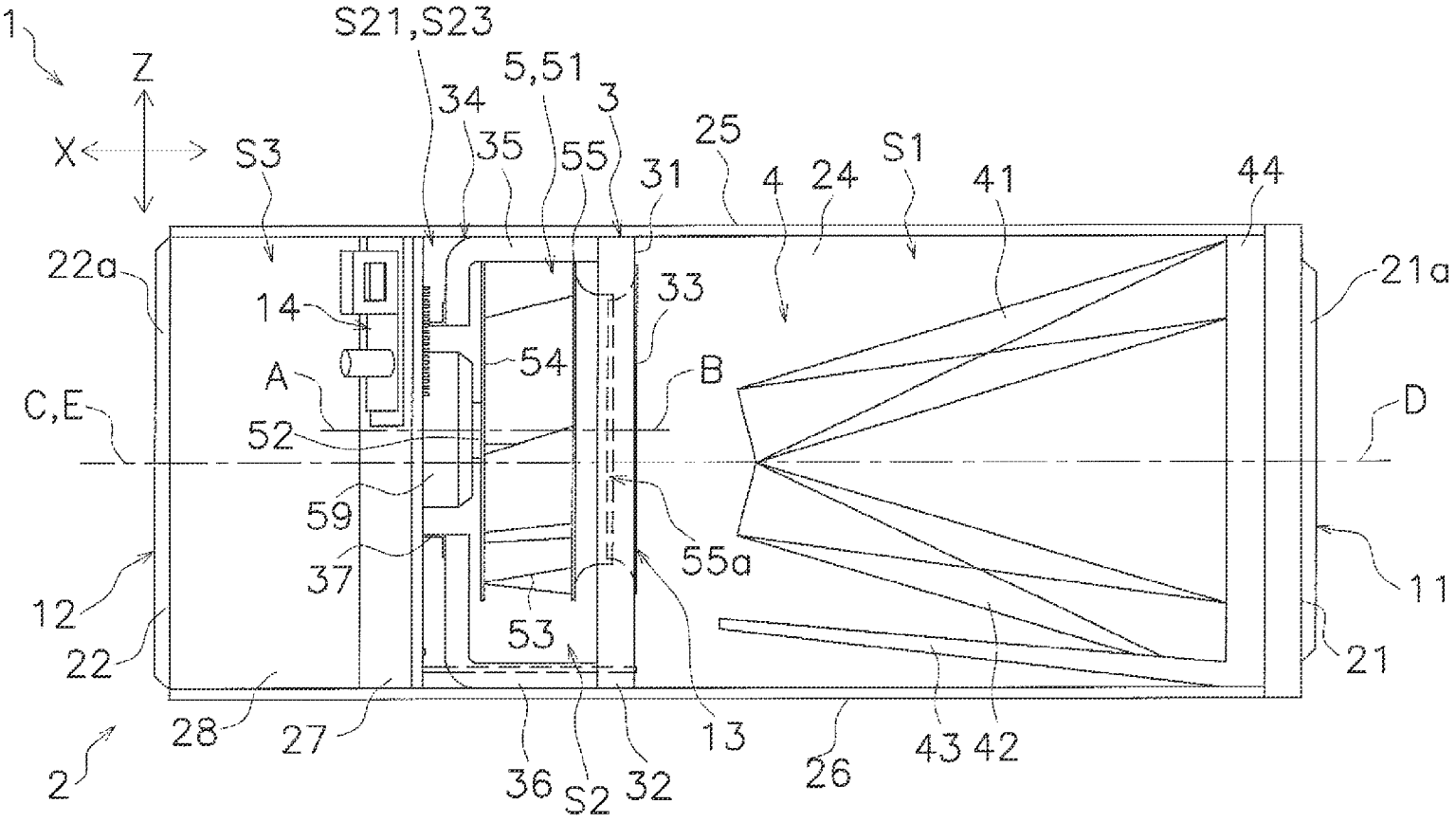
FIG. 8 is a right lateral view of the air conditioning apparatus from which the first lateral part is detached (in the horizontal mount configuration)

First, a basic construction of an air conditioning apparatus 1 will be explained with FIGS. 1 to 8. Here, FIG. 1 is an external perspective view of the air conditioning apparatus 1 according to the preferred embodiment of the present invention (in a vertical mount configuration). FIG. 2 is a front lateral view of the air conditioning apparatus 1 from which a first lateral part 23 is detached (in the vertical mount configuration). FIG. 3 is a rear lateral view of the air conditioning apparatus 1 from which a second lateral part 24 is detached (in the vertical mount configuration). FIG. 4 is a right lateral view of the air conditioning apparatus 1 from which a third lateral part 25 is detached (in the vertical mount configuration). FIG. 5 is a left lateral view of the air conditioning apparatus 1 from which a fourth lateral part 26 is detached (in the vertical mount configuration). FIG. 6 is an external perspective view of a bladed wheel of a centrifugal fan. FIG. 7 is an external perspective view of the air conditioning apparatus 1 (in a horizontal mount configuration). FIG. 8 is a right lateral view of the air conditioning apparatus 1 from which the first lateral part 23 is detached (in the horizontal mount configuration).

The air conditioning apparatus 1 is an apparatus installed in a building in order to perform a cooling operation and a heating operation for the indoor space of the building. The air conditioning apparatus 1 includes a casing 2, a partition member 3, a heat exchanger 4 and a centrifugal fan 5. The casing 2 has an intake port 11 and a blow-out port 12. The partition member 3 divides the interior of the casing 2 into a heat exchanger compartment S1 located on the intake port 11 side and a fan compartment S2 located on the blow-out port 12 side, and has a fan entrance 13 making the heat exchanger compartment S1 and the fan compartment S2 communicate with each other. The heat exchanger 4 is mounted in the heat exchanger compartment S1. The centrifugal fan 5 includes a bladed wheel 51 having a plurality of rearward blades 53 and is configured to suck air existing in the heat exchanger compartment S1 into the fan compartment S2 through the fan entrance 13, with the bladed wheel 51 being mounted in the fan compartment S2 such that a rotary shaft 52 (its axis will be referred to as a rotary axis A) is oriented to an opening direction B of the fan entrance 13.

Moreover, the fan entrance 13 is herein opposed to the blow-out port 12, and the rotary shaft 52 (the rotary axis A) of the bladed wheel 51 is oriented to the opening direction B of the fan entrance 13 and an opening direction C of the blow-out port 12. Furthermore, the intake port 11 is herein opposed to the fan entrance 13, and the rotary shaft 52 (the rotary axis A) of the bladed wheel 51 is oriented to the opening direction B of the fan entrance 13, the opening direction C of the blow-out port 12 and an opening direction D of the intake port 11.

Moreover, the air conditioning apparatus 1 is herein capable of taking two configurations, i.e., the vertical mount configuration and the horizontal mount configuration. In the vertical mount configuration, the casing 2 is disposed such that the rotary shaft 52 (the rotary axis A) of the bladed wheel 51 is oriented to a vertical direction Z (see FIGS. 1 to 5). In the horizontal mount configuration, the casing 2 is disposed such that the rotary shaft 52 (the rotary axis A) of the bladed wheel 51 is oriented to a horizontal direction X (see FIGS. 7 and 8).

As described above, the casing 2 has the intake port 11 and the blow-out port 12. The casing 2 is mainly composed of an upstream lateral part 21, a downstream lateral part 22, the first lateral part 23, the second lateral part 24, the third lateral part 25 and the fourth lateral part 26. These lateral parts 21 to 26 form the elongated cuboid casing 2. The upstream lateral part 21 is a member configured to form the bottom lateral surface of the casing 2 in the vertical mount configuration and form the rear lateral surface of the casing 2 in the horizontal mount configuration. The downstream lateral part 22 is a member configured to form the top lateral surface of the casing 2 in the vertical mount configuration and form the front lateral surface of the casing 2 in the horizontal mount configuration. The upstream lateral part 21 and the downstream lateral part 22 are disposed away from each other in the lengthwise direction of the casing 2 (i.e., a direction along the rotary axis A and the opening directions B, C and D). The upstream lateral part 21 has the intake port 11. The intake port 11 is an opening bored in the middle of the upstream lateral part 21 and is made in the form of a rectangular aperture. The downstream lateral part 22 has the blow-out port 12. The blow-out port 12 is an opening bored in the downstream lateral part 22 so as to be displaced from the middle of the downstream lateral part 22, and is made in the form of a rectangular aperture. The blow-out port 12 is herein located in a position close to the second lateral part 24 within the downstream lateral part 22. The first lateral part 23 is a member configured to form the front lateral surface of the casing 2 in the vertical mount configuration and form the right lateral surface of the casing 2 in the horizontal mount configuration. The second lateral part 24 is a member configured to form the rear lateral surface of the casing 2 in the vertical mount configuration and form the left lateral surface of the casing 2 in the horizontal mount configuration. The first lateral part 23 and the second lateral part 24 are disposed away from each other in a direction orthogonal to the lengthwise direction of the casing 2 (i.e., the horizontal direction X orthogonal to the rotary axis A and the opening directions B, C and D in the vertical mount configuration; a right-and-left direction Y orthogonal to the rotary axis A and the opening directions B, C and D in the horizontal mount configuration). The third lateral part 25 is a member configured to form the right lateral surface of the casing 2 in the vertical mount configuration and form the top lateral surface of the casing 2 in the horizontal mount configuration. The fourth lateral part 26 is a member configured to form the left lateral surface of the casing 2 in the vertical mount configuration and form the bottom lateral surface of the casing 2 in the horizontal mount configuration. The third lateral part 25 and the fourth lateral part 26 are disposed away from each other in a direction orthogonal to the lengthwise direction of the casing 2 (i.e., the right-and-left direction Y orthogonal to the rotary axis A and the opening directions B and C in the vertical mount configuration; the vertical direction Z orthogonal to the rotary axis A and the opening directions B, C and D in the horizontal mount configuration).

Moreover, a plurality of ridges 21*a* are herein formed on the upstream lateral part 21 so as to enclose the circumferential edges of the intake port 11, whereas a plurality of ridges 22*a* are formed on the downstream lateral part 22 so as to enclose the circumferential edges of the blow-out port 12. Furthermore, an intake duct 18 is connected to the intake port 11 through the ridges 21*a*, whereas a blow-out duct 19 is connected to the blow-out port 12 through the ridges 22*a*. With the construction, the air conditioning apparatus 1 is herein configured to be of a duct connection type for sucking and blowing air from and to an air-conditioned room indirectly through the ducts 18 and 19. It should be herein noted that the intake port 11 and the blow-out port 12 are made in forms of rectangular apertures, and likewise, the ducts 18 and 19 are made in forms of rectangular tubes. However, the ports 11 and 12 and the ducts 18 and 19 are not limited to be made in the aforementioned forms, and may employ a variety of forms. Furthermore, the air conditioning apparatus 1 is not limited to be of the duct connection type, and may be of a variety of types such as a type for sucking and blowing air from and to an air-conditioned room directly through the intake port 11 and the blow-out port 12.

As described above, the partition member 3 divides the interior of the casing 2 into the heat exchanger compartment S1 located on the intake port 11 side and the fan compartment S2 located on the blow-out port 12 side, and has the fan entrance 13 that makes the heat exchanger compartment S1 and the fan compartment S2 communicate with each other.

The partition member 3 is mainly composed of a partition body 31 made in the form of a rectangular plate. The partition body 31 is disposed in parallel to a direction orthogonal to the lengthwise direction of the casing 2 (i.e., a direction orthogonal to the rotary axis A and the opening directions B, C and D). The fan entrance 13 is bored in the partition body 31 and is herein made in the form of a circular aperture. The partition body 31 has a partition circumferential part 32 made in the form of a rectangular frame. The partition circumferential part 32 extends from the circumferential edges of the partition body 31 toward the fan compartment S2 along the inner surfaces of the lateral parts 23 to 26 of the casing 2.

As described above, the heat exchanger 4 is mounted in the heat exchanger compartment S1. In a cooling operation, the heat exchanger 4 is configured to cool air flowing through the heat exchanger compartment S1 by a refrigerant. Contrarily in a heating operation, the heat exchanger 4 is also capable of heating air flowing through the heat exchanger compartment S1 by the refrigerant. A fin tube heat exchanger, composed of multiple fins and a heat transfer tube, is herein employed as the heat exchanger 4. Furthermore, the refrigerant is configured to be supplied to the heat exchanger 4 from an outdoor unit installed outside the building or so forth. The heat exchanger 4 is composed of a part 41 located closely to the third lateral part 25 of the casing 2 and a part 42 located closely to the fourth lateral part 26 of the casing 2. Moreover, the part 41 of the heat exchanger 4, located closely to the third lateral part 25, is disposed in a tilt position so as to get closer to the third lateral part 25 from a side near to the fan entrance 13 to a side near to the intake port 11. The part 42 of the heat exchanger 4, located closely to the fourth lateral part 26, is disposed in a tilt position so as to get closer to the fourth lateral part 26 from the side near to the fan entrance 13 to the side near to the intake port 11. With the construction, the heat exchanger 4 has a V shape so as to get closer to the third lateral part 25 and the fourth lateral part 26 of the casing 2 from the side near to the fan entrance 13 to the side near to the intake port 11. It should be noted that the heat exchanger 4 is not limited to have the V shape, and may employ a variety of shapes.

Moreover, drain pans 43 and 44 are mounted in the heat exchanger compartment S1 in order to receive water produced by dew condensation in the heat exchanger 4. The first drain pan 43 is configured to be used when the casing 2 is disposed such that the rotary shaft 52 (the rotary axis A) of the bladed wheel 51 is oriented to the horizontal direction X (in the horizontal mount configuration). The second drain pan 44 is configured to be used when the casing 2 is disposed such that the rotary shaft 52 (the rotary axis A) of the bladed wheel 51 is oriented to the vertical direction Z (in the vertical mount configuration). The first drain pan 43 is disposed in a position close to the fourth lateral part 26, which is one of the lateral parts 23 to 26 of the casing 2 that are disposed along the opening direction B of the fan entrance 13. With the construction, the first drain pan 43 is configured to be disposed over the fourth lateral part 26 forming the bottom lateral surface of the casing 2 and receive the bottom side of the heat exchanger 4 in the horizontal mount configuration. The second drain pan 44 is disposed in a position close to the upstream lateral part 21, which is one of the lateral parts 21 and 22 of the casing 2 that are disposed along the direction orthogonal to the opening direction B of the fan entrance 13. With the construction, the second drain pan 44 is configured to be disposed over the upstream lateral part 21 forming the bottom lateral surface of the casing 2 and receive the bottom side of the heat exchanger 4 in the vertical mount configuration. Furthermore, the first and second drain pans 43 and 44 are herein compatible with the vertical mount configuration and the horizontal mount configuration, but the first drain pan 43 to be used in the horizontal mount configuration exists in the heat exchanger compartment S1 even in the vertical mount configuration, whereas the second drain pan 44 to be used in the vertical mount configuration exists in the heat exchanger compartment S1 even in the horizontal mount configuration.

As described above, the centrifugal fan 5 includes the bladed wheel 51 having the plural rearward blades 53 and is configured to suck air existing in the heat exchanger compartment S1 into the fan compartment S2 through the fan entrance 13, with the bladed wheel 51 being mounted in the fan compartment S2 such that the rotary shaft 52 (the rotary axis A) is oriented to the opening direction B of the fan entrance 13. Furthermore, a fan motor 59 is mounted in the fan compartment S2 in order to drive and rotate the bladed wheel 51. Here in the fan compartment 2, the bladed wheel 51 is disposed proximally to the fan entrance 13 and the fan motor 59 is disposed on the downwind side of the bladed wheel 51 along the rotary shaft 52 (the rotary axis A) of the bladed wheel 51. Moreover, a bell mouth 33 is mounted to the fan entrance 13. A space, located on the downwind side of the bladed wheel 51 in the fan compartment S2, is herein defined as a fan downwind space S21. Thus, the fan motor 59 is disposed in the fan downwind space S21.

The bladed wheel 51 is composed of a hub 54, a shroud 55 and the plural rearward blades 53 disposed between the hub 54 and the shroud 55. The hub 54 connects the blow-out port 12 side ends of the plural rearward blades 53, and is configured to be rotated about the rotary shaft 52 (the rotary axis A). The hub 54 is a disc-shaped member and has a hub protrusion 54*a* protruding from its middle toward the shroud 55. The hub protrusion 54*a* is coupled to the fan motor 59. The shroud 55 is disposed on the fan entrance 13 side of the hub 54 so as to be opposed to the hub 54, connects the fan entrance 13 side ends of the plural rearward blades 53, and is configured to be rotated about the rotary shaft 52 (the rotary axis A). The shroud 55 is an annular member and has a fan opening 55*a* that is bored in the form of a circular aperture and is centered at the rotary shaft 52 (the rotary axis A). The shroud 55 has a curved shape that its outer diameter increases toward a side near to the hub 54. The plural rearward blades 53 are disposed between the hub 54 and the shroud 55 so as to be aligned at predetermined intervals along the circumferential direction of the rotary shaft 52 (the rotary axis A). Each rearward blade 53 tilts oppositely to a rotary direction R of the bladed wheel 51 (herein a clockwise direction in a view seen from the blow-out port 12 side) with respect to the radial direction of the hub 54.

The bell mouth 33 is mounted to the fan entrance 13 of the partition member 3 so as to be opposed to the fan opening 55*a* of the bladed wheel 51 and directs air, flowing thereto from the heat exchanger compartment S1, to the fan opening 55*a* of the bladed wheel 51. The bell mouth 33 is an annular member centered at the rotary shaft 52 (the rotary axis A). The bell mouth 33 has a curved shape that its outer diameter decreases toward a side near to the shroud 55.

The fan motor 59 is disposed concentrically to the rotary shaft 52 (the rotary axis A) of the bladed wheel 51 in the fan downwind space S21. The fan motor 59 has a columnar shape centered at the rotary shaft 52 (the rotary axis A). The fan motor 59 is herein fixed to the partition member 3 through a motor support base 34. Specifically, the motor support base 34 is composed of support frames 35 and 36 forming a roughly squared U shape. The support frames 35 and 36 respectively extend toward the vicinity of the outer peripheral surface of the fan motor 59 from parts of the partition circumferential part 32 of the partition member 3, i.e., a part located closely to the third lateral part 25 of the casing 2 and a part located closely to the fourth lateral part 26 of the casing 2. Moreover, the fan motor 59 is fixed at its end plate parts 59*a* to the support frames 35 and 36 through a bracket 37. The end plate parts 59*a* extend from the outer peripheral surface of the fan motor 59 toward the third lateral part 25 and the fourth lateral part 26. Thus, the centrifugal fan 5, including the bladed wheel 51 and the fan motor 59, is designed to be fixed to the partition member 3 through the motor support base 34. With the construction, the entirely of the centrifugal fan 5 is configured to be detachable by detaching the partition member 3 from the casing 2 in performing a maintenance work or so forth.

Moreover, the fan downwind space S21 of the fan compartment S2 has a blow-out port opposed space S22 as a region opposed to the blow-out port 12. The blow-out port 12 is herein disposed in the position close to the second lateral part 24 within the downstream lateral part 22. Thus, when the casing 2 is seen from the blow-out port 12 side, the blow-out port opposed space S22 is formed by a space enclosed by parts located along the circumferential edges of the opening of the blow-out port 12, i.e., the second lateral part 24, a part of the third lateral part 25 that is located closely to the second lateral part 24, and a part of the fourth lateral part 26 that is located closely to the second lateral part 24. Furthermore, a blow-out port non-opposed surface part 27 is mounted in a position on the downwind side of the bladed wheel 51 so as to be opposed to the fan entrance 13, and accordingly, a blow-out port non-opposed space S23 is formed as a space excluding the blow-out port opposed space S22 within the fan downwind space S21 so as not to be opposed to the blow-out port 12 but to be opposed to the blow-out port non-opposed surface part 27. Moreover, a blow-out port circumferential surface part 28 is herein provided so as to extend from the blow-out port 12 side end of the blow-out port non-opposed surface part 27 toward the blow-out port 12 along the opening direction B of the fan entrance 13 and the opening direction C of the blow-out port 12. With the construction, an electric component compartment S3 is herein formed by the blow-out port non-opposed surface part 27, the blow-out port circumferential surface part 28, the first lateral part 23, the third lateral part 25, the fourth lateral part 26, and a part of the downstream lateral part 22 that is located closely to the first lateral part 23 and in which the blow-out port 12 is not formed. The electric component compartment S3 accommodates electric components 14 to be used for controlling devices that make up the air conditioning apparatus 1. Furthermore, a blow-out pathway region S24, having the same opening size as the blow-out port 12, is formed by a region located closely to the blow-out port 12 within the blow-out port opposed space S22, i.e., a space enclosed by the blow-out port circumferential surface part 28, the second lateral part 24, a part of the third lateral part 25 that is located closely to the second lateral part 24, and a part of the fourth lateral part 26 that is located closely to the second lateral part 24.

Moreover, an electric heater 6 is herein mounted in the fan downwind space S21 of the fan compartment S2 in order to heat air blown out to the fan downwind space S21 by the bladed wheel 51 of the centrifugal fan 5. The electric heater 6 is heating means for heating air flowing through the fan compartment S2 in a heating operation. A heating element assembly with coiled electric heating wires is herein employed as the electric heater 6 (heating means). The electric heater 6 (the heating means) is disposed in the blow-out port opposed space S22, i.e., a region opposed to the blow-out port 12 within the fan downwind space S21. More specifically, the electric heater 6 (the heating means) is disposed in the blow-out pathway region S24 close to the blow-out port 12 within the blow-out port opposed space S22. It should be noted that the electric heater 6 (the heating means) is not limited to the heating element assembly with the coiled electric heating wires, and alternatively, may employ a variety of types of heater.

(2) Basic Action of Air Conditioning Apparatus

Next, a basic action of the air conditioning apparatus 1 will be explained with FIGS. 1 to 8.

In the air conditioning apparatus 1 having the aforementioned construction, the bladed wheel 51 of the centrifugal fan 5 is configured to be rotated by driving of the fan motor 59. This produces the flow of air passing through the interior of the casing 2 sequentially in the order of the intake port 11, the heat exchanger compartment S1, the fan entrance 13, the fan compartment S2 and the blow-out port 12.

Now in the cooling operation, air fed to the interior of the casing 2 through the intake port 11 flows into the heat exchanger compartment S1, and is cooled by the refrigerant flowing through the heat exchanger 4. Then, the air cooled by the heat exchanger 4 flows into the fan compartment S2 through the fan entrance 13 and is sucked into the bladed wheel 51 of the centrifugal fan 5. The air sucked into the bladed wheel 51 is blown out to the fan downwind space S21 located on the downwind side of the bladed wheel 51. The air blown out to the fan downwind space S21 is fed to the outside of the casing 2 through the blow-out port 12.

On the other hand, in the heating operation, air fed to the interior of the casing 2 through the intake port 11 flows into the heat exchanger compartment S1, and is heated by the refrigerant flowing through the heat exchanger 4. The air heated by the heat exchanger 4 flows into the fan compartment S2 through the fan entrance 13, and is sucked into the bladed wheel 51 of the centrifugal fan 5. The air sucked into the bladed wheel 51 is blown out to the fan downwind space S21 located on the downwind side of the bladed wheel 51. The air blown out to the fan downwind space S21 is further heated by the electric heater 6 (the heating means), and is then fed to the outside of the casing 2 through the blow-out port 12.

(3) Construction for Performing Rotation Speed Control of Centrifugal Fan

In the air conditioning apparatus 1 having the aforementioned construction, it is preferable to perform rotation speed control of the centrifugal fan 5 in accordance with operating conditions and so forth. It should be herein noted that in consideration of facts, including that variation in output of the fan motor 59 of the centrifugal fan 5 is small, it is preferable to detect a primary-side pressure P1 of the centrifugal fan 5 with use of a pressure sensor and perform rotational speed control of the centrifugal fan 5 on the basis of the primary-side pressure P1.

Figure 9:
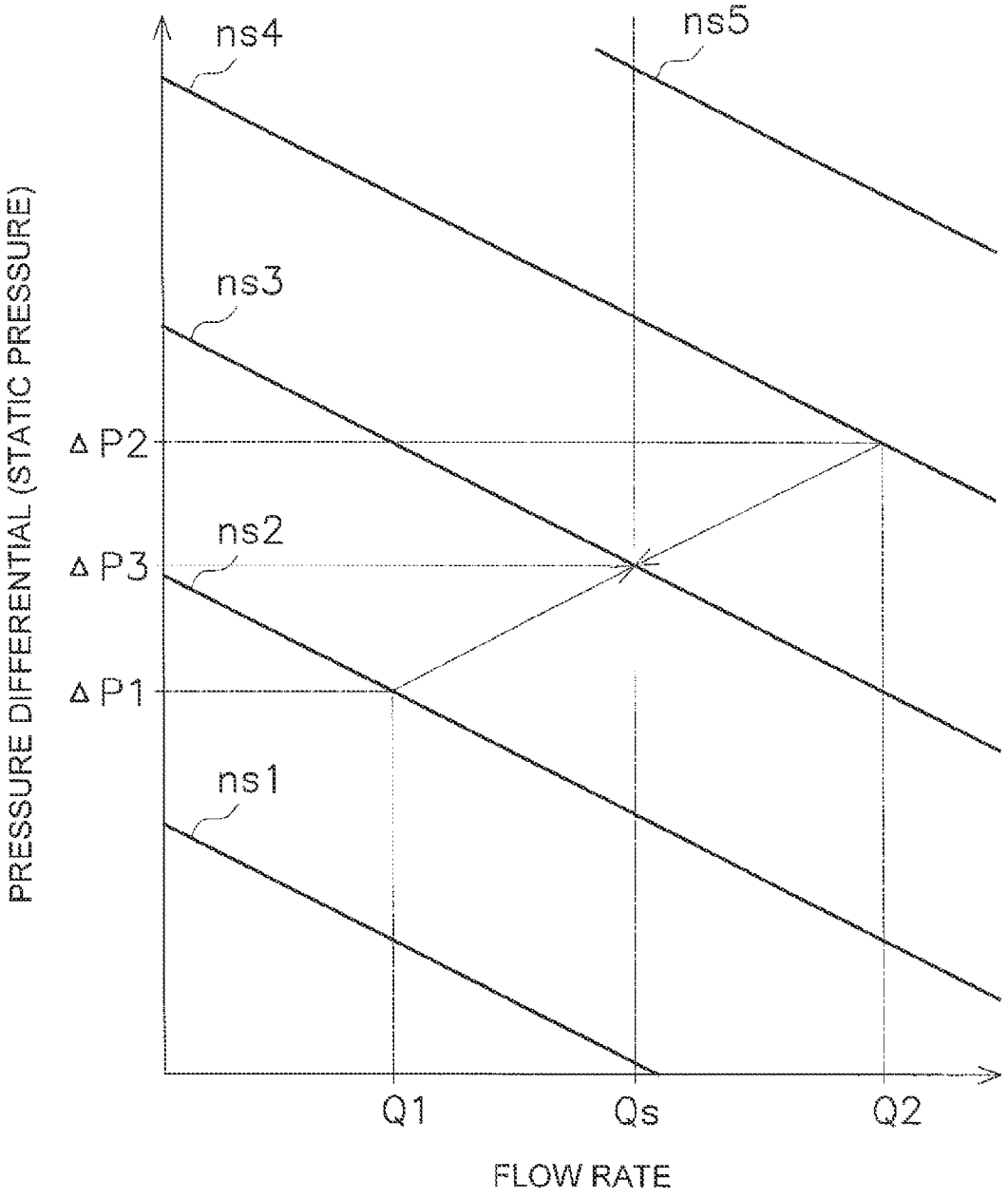
FIG. 9 is a chart showing flow rate and static pressure characteristics of the centrifugal fan.

For example, a pressure differential ΔP (static pressure) between the primary-side pressure P1 and a secondary-side pressure P2 of the centrifugal fan 5 is obtained with use of flow rate and static pressure characteristics of the centrifugal fan 5 as shown in FIG. 9. Then, a rotational speed ns of the centrifugal fan 5 (herein, the fan motor 59) is controlled on the basis of the pressure differential ΔP such that a flow rate Q of air from the centrifugal fan 5 can be constant at a target flow rate Qs. Specifically, where the value of the rotational speed ns is ns2 and the value of the pressure differential ΔP detected by the pressure sensor is ΔP1, the flow rate and static pressure characteristics shown in FIG. 9 indicates a condition that the value of the flow rate Q is Q1 lower than the target flow rate Qs. Then, control is performed for this condition in order to increase the rotation speed ns from ns2 to ns3. Accordingly, the pressure differential ΔP increases and its value approaches ΔP3, whereas the flow rate Q increases and its value approaches the target flow rate Qs. On the other hand, where the value of the rotational speed ns is ns4 and the value of the pressure differential ΔP detected by the pressure sensor is ΔP2, the flow rate and static pressure characteristics shown in FIG. 9 indicates a condition that the value of the flow rate Q is Q2 higher than the target flow rate Qs. Then, control is performed for this condition in order to reduce the rotation speed ns from ns4 to ns3. Accordingly, the pressure differential ΔP decreases and its value reaches ΔP3, whereas the flow rate Q decreases and its value reaches the target flow rate Qs. In this manner, the rotation speed control of the centrifugal fan 5 can be performed. It should be noted that the rotation speed control of the centrifugal fan 5 is performed by a control unit (not shown in the drawings) composed of a microcomputer, a memory and so forth included in the electric components 14.

However, it is indispensable to accurately detect the primary-side pressure P1 of the centrifugal fan 5 in order to accurately perform the rotation speed control of the centrifugal fan 5 as described above.

Figure 10:
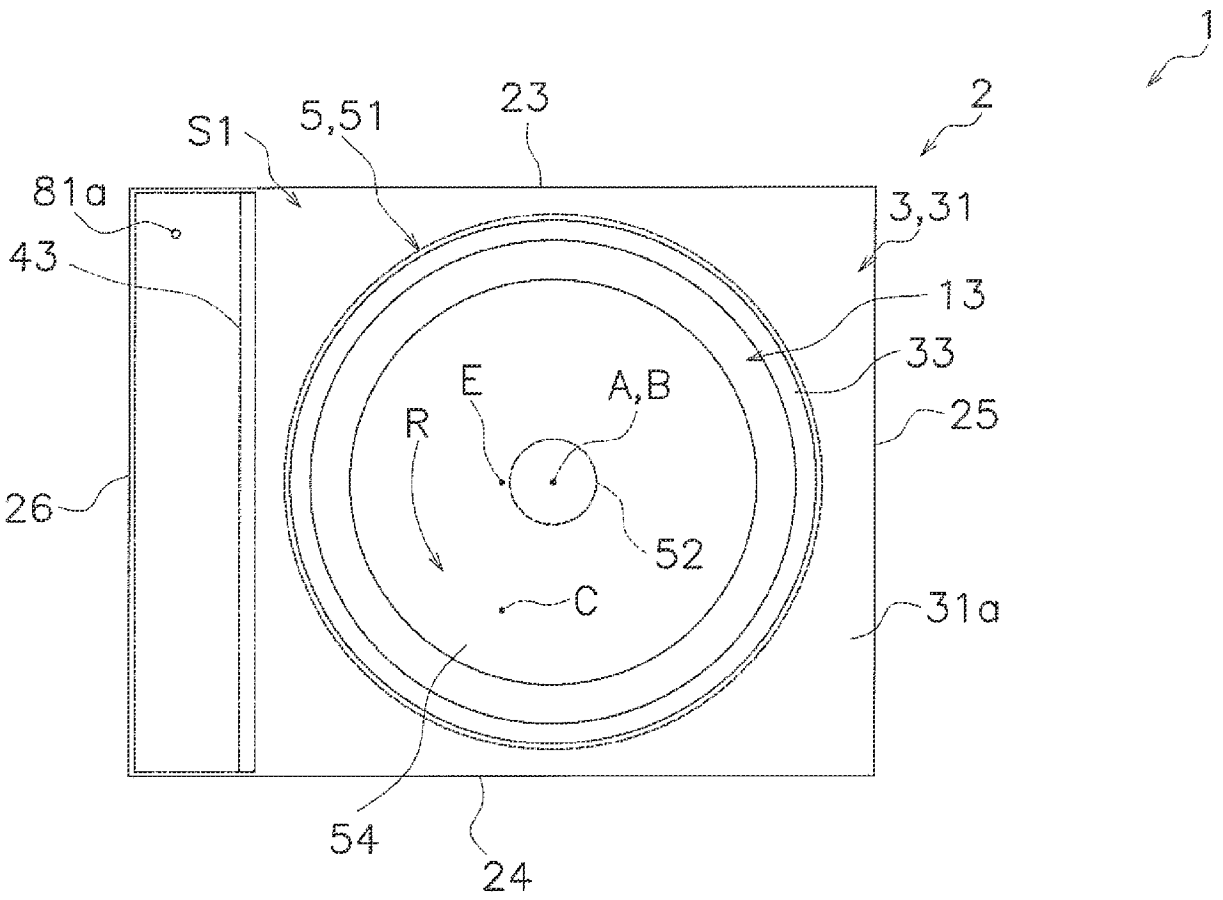
FIG. 10 is a cross-sectional view of FIG. 2 taken along line I-I.
Figure 11:
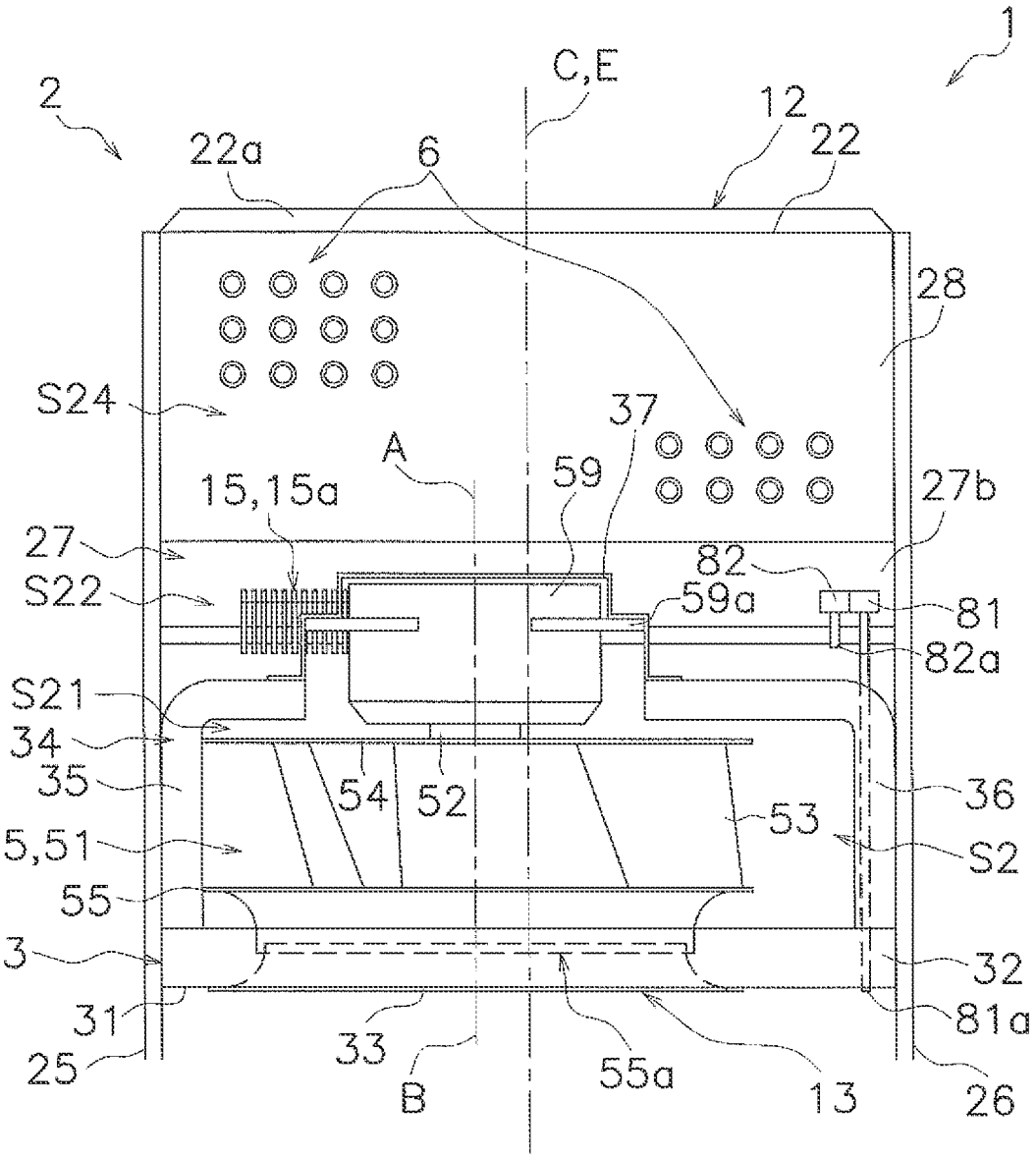
FIG. 11 is an enlarged view of a fan compartment and its vicinity in FIG. 3.
Figure 12:
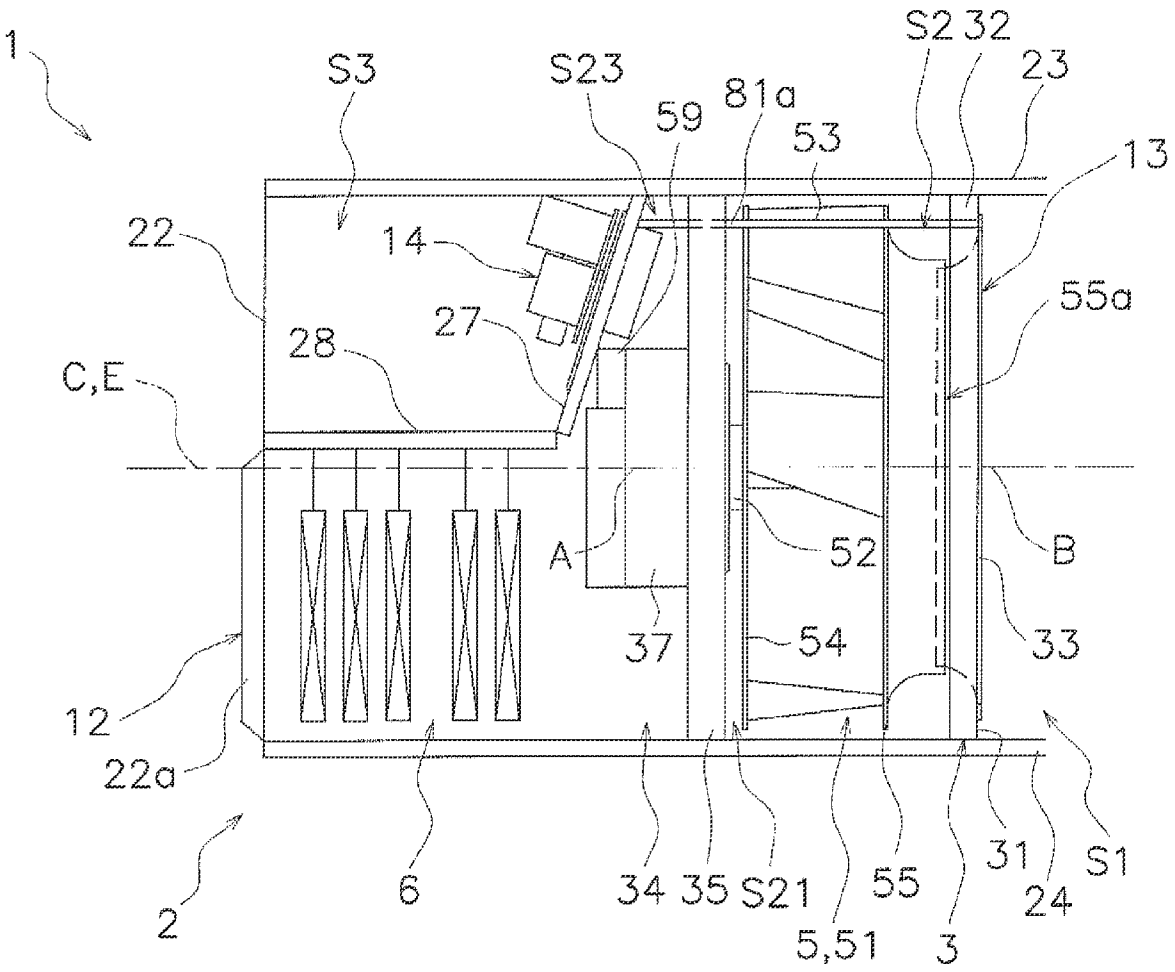
FIG. 12 is an enlarged view of the fan compartment and its vicinity in FIG. 5.

In view of the above, a primary-side pressure detection tube 81*a* of a pressure sensor 81 for detecting the primary-side pressure P1 of the centrifugal fan 5 is herein contrived in positional arrangement. Specifically, when the bell mouth 33 (the partition member 3) is seen from a direction along the rotary shaft 52 (the rotational axis A), the primary-side pressure detection tube 81*a* of the pressure sensor 81 for detecting the primary-side pressure P1 of the centrifugal fan 5 is opened in a position close to the circumferential part of the casing 2 on an inlet side surface of the bell mouth 33 (i.e., a heat exchanger compartment S1 side surface 31*a* of the partition member 3) (see FIGS. 10 to 12). Put differently, the primary-side pressure detection tube 81*a* of the pressure sensor 81 is opened to the heat exchanger compartment S1 in a region located on the outer peripheral side of the fan entrance 13 on the heat exchanger compartment S1 side surface 31*a* of the partition body 31 mainly composing the partition member 3. The primary-side pressure detection tube 81*a* is herein opened to the heat exchanger compartment S1 in a position close to the first lateral part 23 and the fourth lateral part 26 in the region located on the outer peripheral side of the fan entrance 13 on the surface 31*a* of the partition body 31. Furthermore, a secondary-side pressure detection tube 82*a* of a pressure sensor 82 for detecting the secondary-side pressure P2 of the centrifugal fan 5 is opened in the fan compartment S2 (see FIG. 11). Now, FIG. 10 is a cross-sectional view of FIG. 2 taken along line I-I; FIG. 11 is an enlarged view of the fan compartment S2 and its vicinity in FIG. 3; and FIG. 12 is an enlarged view of the fan compartment S2 and its vicinity in FIG. 5.

It should be herein noted that the two pressure sensors 81 and 82 are herein provided and configured to detect the primary-side pressure P1 and the secondary-side pressure P2 with use of the respective pressure detection tubes 81*a* and 82*a*. However, the pressure sensor construction is not limited to the above. For example, one pressure differential sensor equipped with two pressure detection tubes may be provided instead of the two pressure sensors. In the construction, one of the pressure detection tubes may be used for detecting the primary-side pressure P1, whereas the other of the pressure detection tubes may be used for detecting the secondary-side pressure P2.

Thus, the primary-side pressure detection tube 81*a* of the pressure sensor 81 for detecting the primary-side pressure P1 of the centrifugal fan 5 is herein designed to be opened in the position close to the circumferential part of the casing 2 on the heat exchanger compartment S1 side surface 31*a* of the partition member 3 having the fan entrance 13. With the construction, the primary-side pressure detection tube 81*a* is herein opened in a position unlikely to be affected by dynamic pressure in the vicinity of the fan opening 55*a* (the fan entrance 13) on the inlet side surface of the bell mouth 33 (i.e., the heat exchanger compartment S1 side surface 31*a* of the partition member 3).

Consequently, the primary-side pressure P1 of the centrifugal fan 5 can be herein accurately detected, and the rotational speed control of the centrifugal fan 5 can be accurately performed on the basis of the primary-side pressure P1 thus detected by the primary-side pressure detection tube 81*a* as described above.

Moreover, when seen from the direction along the rotary shaft 52 (the rotational axis A), the primary-side pressure detection tube 81*a* is herein opened in a position close to a corner of the circumferential part of the casing 2 (see FIG. 10). Put differently, the primary-side pressure detection tube 81*a* is opened in the vicinity of a joint between two of the lateral parts 23 to 26 composing the casing 2 within a region located on the outer peripheral side of the fan entrance 13 on the surface 31*a* of the partition body 31. The primary-side pressure detection tube 81*a* is herein opened in the corner formed by the first lateral part 23 and the fourth lateral part 26 (i.e., the vicinity of the joint between the first lateral part 23 and the fourth lateral part 26).

Thus, the primary-side pressure detection tube 81*a* is herein opened in the position close to the corner of the circumferential part of the casing 2. With the construction, the primary-side pressure detection tube 81*a* is herein opened in a position more unlikely to be affected by dynamic pressure in the vicinity of the fan opening 55*a* (the fan entrance 13) on the inlet side surface of the bell mount 33 (i.e., the heat exchanger compartment S1 side surface 31*a* of the partition member 3).

Consequently, the primary-side pressure P1 of the centrifugal fan 5 can be herein more accurately detected.

Moreover, the pressure sensor 81 is herein disposed on the fan compartment S2 side of the partition member 3. Additionally, when seen from the direction along the rotary shaft 52 (the rotational axis A), the primary-side pressure detection tube 81*a* extends from the pressure sensor 81 to the partition member 3 along the lateral parts 23 to 26 composing the circumferential part of the casing 2 (see FIGS. 11 and 12). The pressure sensor 81 is herein mounted to the blow-out port non-opposed surface part 27, and extends therefrom to the partition member 3 through a region located on the outer peripheral side of the bladed wheel 51 within the fan compartment S2. On the other hand, the pressure sensor 82 is also disposed on the fan compartment S2 side of the partition member 3. Additionally, the secondary-side pressure detection tube 82*a* is opened in the space S21 located on the downwind side of the bladed wheel 51 within the fan compartment S2.

Thus, when herein constructed to extend to the partition member 3 from the pressure sensor 81 disposed on the fan compartment S2 side, the primary-side pressure detection tube 81*a* is designed to extend along the lateral parts 23 to 26 composing the circumferential part of the casing 2. With the construction, the primary-side pressure detection tube 81*a* can be disposed in a position that the flow of air blown out by the centrifugal fan 5 is unlikely to be blocked by the primary-side pressure detection tube 81*a*.

Consequently, degradation in ventilation performance of the centrifugal fan 5 can be herein inhibited as much as possible, and simultaneously, the primary-side pressure detection tube 81*a* can be constructed to extend to the partition member 3 from the pressure sensor 81 disposed on the fan compartment S2 side.

Moreover, the rotary shaft 52 (the rotational axis A) of the bladed wheel 51 is disposed in a position close to the third lateral part 25 (a bladed wheel nearby lateral part), which is one of the lateral parts 23 to 26 of the casing 2 that are disposed along the opening direction B of the fan entrance 13 (see FIGS. 2, 3, 8, 10 and 11). Put differently, the rotary shaft 52 (the rotational axis A) of the bladed wheel 51 is herein disposed so as to be displaced closely to the third lateral part 25 (the bladed wheel nearby lateral part) with respect to a halfway line E between the third lateral part 25 and the fourth lateral part 26. Furthermore, the fan entrance 13 and the bell mouth 33 are also designed to be disposed in positions close to the third lateral part 25 (the bladed wheel nearby lateral part) within the partition member 3 due to the construction that the rotary shaft 52 (the rotational axis A) of the bladed wheel 51 is disposed in the position close to the third lateral part 25 (the bladed wheel nearby lateral part). Additionally, the primary-side pressure detection tube 81*a* is opened in the position close to the lateral part of the casing 2 (herein, the fourth lateral part 26) that is opposed to the third lateral part 25 (the bladed wheel nearby lateral part). Put differently, the primary-side pressure detection tube 81*a* is disposed in a position away from the fan entrance 13 within a region located closely to the circumferential part of the casing 2 on the surface 31*a* of the partition member 3. Furthermore, the first drain pan 43 is herein also disposed in a position close to the fourth lateral part 26 under the partition member 3. Hence, the primary-side pressure detection tube 81*a* is disposed in a position close to the first drain pan 43 within the region located closely to the circumferential part of the casing 2 on the surface 31*a* of the partition member 3.

It should be herein noted that the rotary shaft 52 (the rotational axis A) of the bladed wheel 51 is disposed in the position close to the third lateral part 25, whereas the primary-side pressure detection tube 81*a* is disposed in the position close to the fourth lateral part 26 opposed to the third lateral part 25. However, the positional arrangements of the rotary shaft 52 (the rotational axis A) and the primary-side pressure detection tube 81*a* are not limited to the above. For example, the rotary shaft 52 (the rotational axis A) of the bladed wheel 51 may be disposed in a position close to another lateral part such as the fourth lateral part 26, whereas the primary-side pressure detection tube 81*a* may be disposed in a position close to yet another lateral part such as the third lateral part 25 opposed to the fourth lateral part 26.

Thus, the rotary shaft 52 (the rotational axis A) of the bladed wheel 51 is herein designed to be disposed closely to the bladed wheel nearby lateral part, whereas the primary-side pressure detection tube 81*a* is designed to be opened in the position close to the lateral part opposed to the bladed wheel nearby lateral part. With the construction, the primary-side pressure detection tube 81*a* is herein opened in a position more unlikely to be affected by dynamic pressure in the vicinity of the fan entrance 13 on the heat exchanger compartment S1 side surface 31*a* of the partition member 3.

Consequently, the primary-side pressure P1 of the centrifugal fan 5 can be herein more accurately detected.

(4) Modifications

In the aforementioned preferred embodiment, contrivance in positional arrangement of the primary-side pressure detection tube according to the present invention has been applied to the air conditioning apparatus that the centrifugal fan is mounted within the casing divided into the heat exchanger compartment and the fan compartment through the partition member. However, the contrivance in positional arrangement of the primary-side pressure detection tube is also applicable to other types of air conditioning apparatuses.

Figure 13:
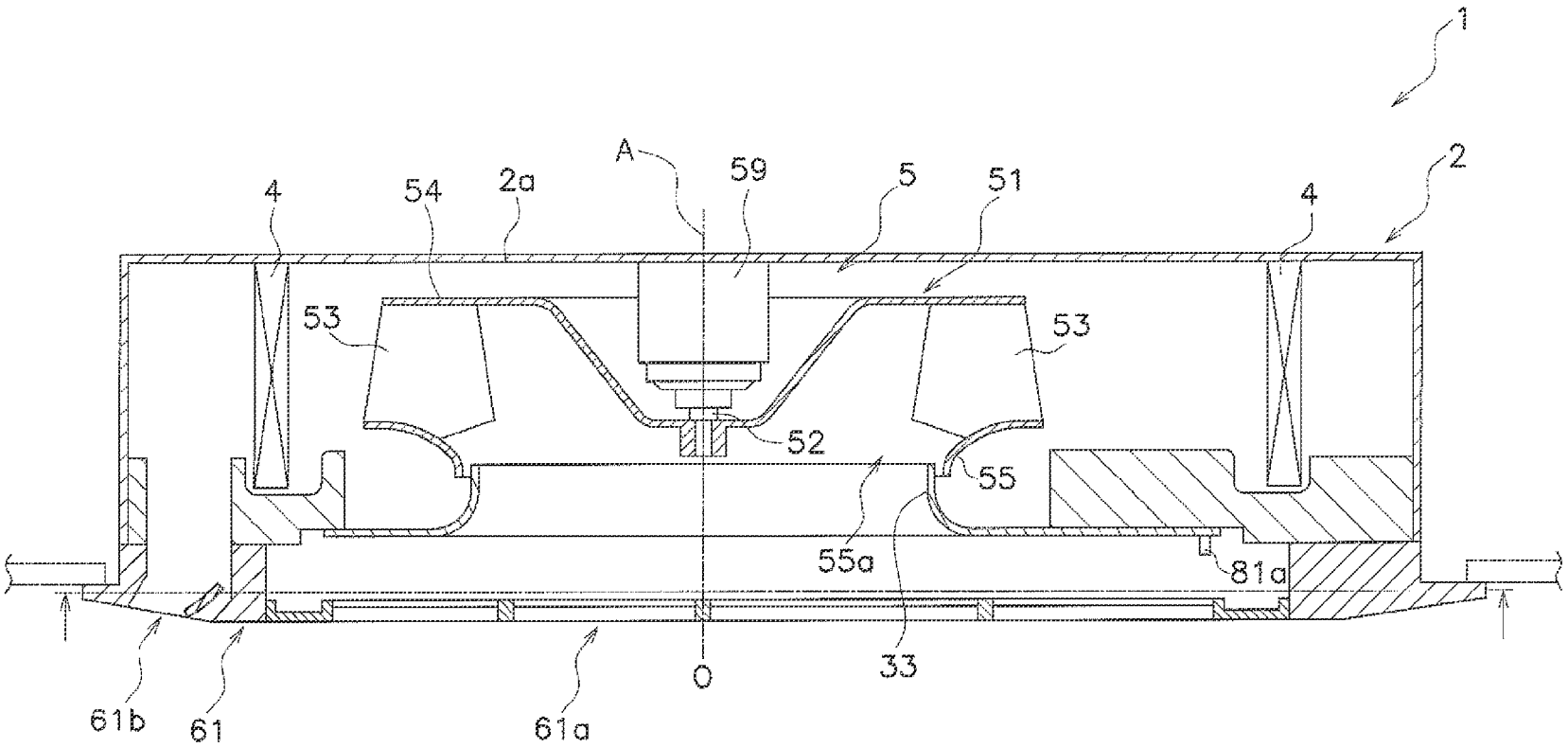
FIG. 13 is a vertical cross-sectional view of an air conditioning apparatus according to a modification.
Figure 14:
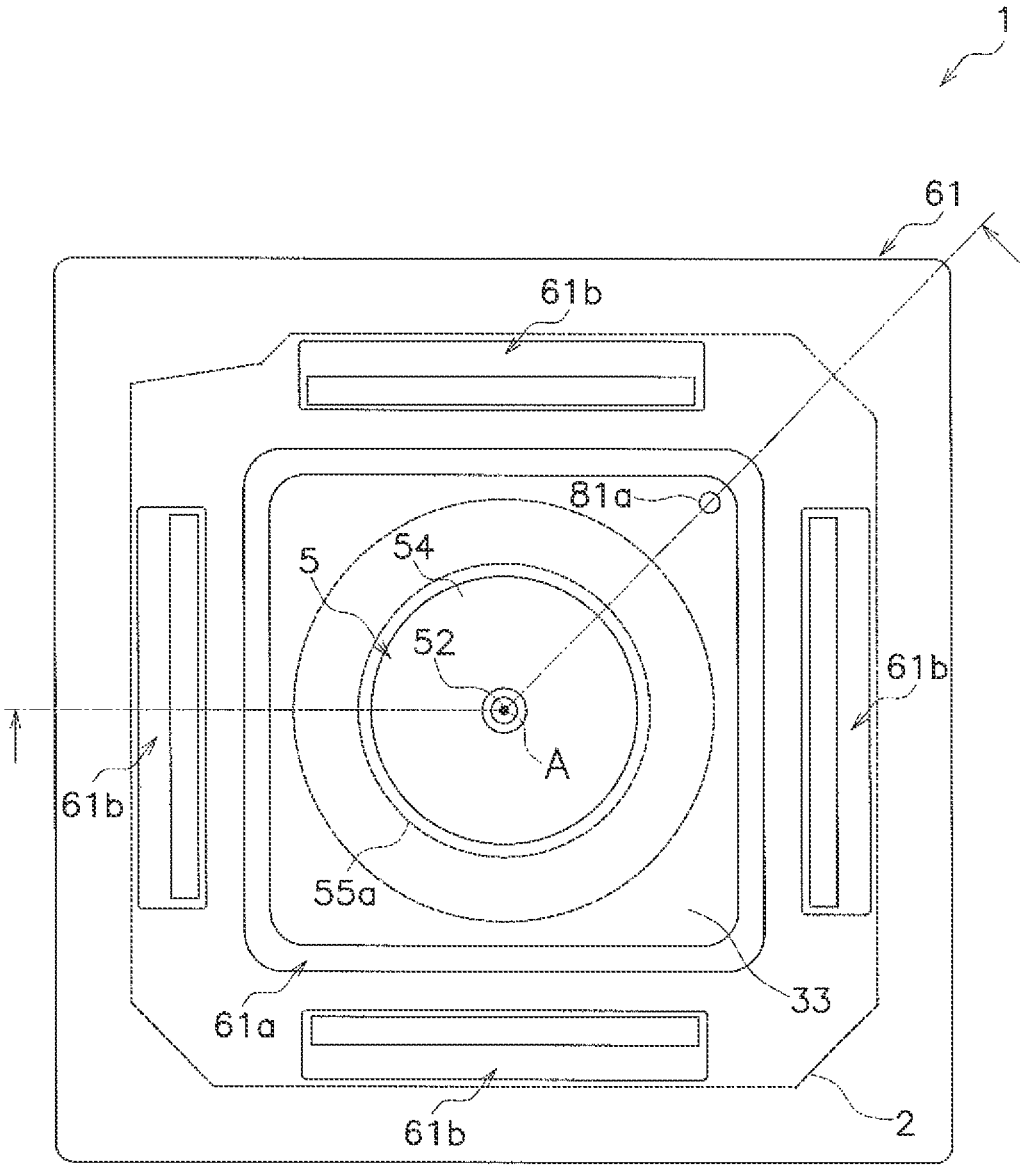
FIG. 14 is a bottom lateral view of the air conditioning apparatus according to the modification.

For example, the contrivance in positional arrangement of the primary-side pressure detection tube 81*a* according to the present invention is also applicable to a ceiling embedded type air conditioning apparatus 1 that the centrifugal fan 5 is mounted within the casing 2 as shown in FIGS. 13 and 14.

Specifically, the ceiling embedded type air conditioning apparatus 1 includes the casing 2, the heat exchanger 4 and the centrifugal fan 5. The casing 2 has a cuboid shape and the bottom surface thereof is opened. The bottom opening is covered with a ceiling panel 61 and so forth. An air intake port 61*a* is bored in the middle part of the ceiling panel 61, and air blow-out ports 61*b* are bored in the outer peripheral part of the ceiling panel 61 so as to enclose the air intake port 61*a*. Furthermore, the heat exchanger 4 and the centrifugal fan 5 are disposed inside the casing 2. The centrifugal fan 5 is disposed inside the casing 2 such that the rotary shaft 52 (the rotational axis A) thereof is oriented to the vertical direction. Similarly to the aforementioned preferred embodiment, the centrifugal fan 5 herein mainly includes the fan motor 59, the bladed wheel 51 and the bell mouth 33. The fan motor 59 is supported by a top plate 2*a* of the casing 2. The bladed wheel 51 is composed of the hub 54, the shroud 55 and a plurality of rearward blades 53. The hub 54 is a member to which the rotary shaft 52 is coupled. The shroud 55 is opposed to the hub 54 and has the fan opening 55*a* bored in the center thereof. The rearward blades 53 are disposed between the outer peripheral part of the hub 54 and that of the shroud 55. The bell mouth 33 is disposed between the fan opening 55*a* of the bladed wheel 51 and the air intake port 61*a* of the ceiling panel 61 in the vertical direction, and the outlet end thereof is inserted into the fan opening 55*a*. The heat exchanger 4 is disposed so as to enclose the outer peripheral part of the centrifugal fan 5.

Moreover, in the ceiling embedded type air conditioning apparatus 1, similarly to the aforementioned preferred embodiment, the primary-side pressure detection tube 81*a* of the pressure sensor is also designed to be opened in a position close to the circumferential part (herein, the air blow-out ports 61*b*) of the casing 2 on the inlet side surface (herein, the bottom surface) of the bell mouth 33 when the bell mouth 33 is seen from a direction along the rotary shaft 52 (the rotational axis A). With the construction, the primary-side pressure detection tube 81*a* is herein opened in a position unlikely to be affected by dynamic pressure in the vicinity of the fan opening 55*a* on the inlet side surface of the bell mouth 33. Consequently, the primary-side pressure P1 of the centrifugal fan 5 can be herein accurately detected, and similarly to the aforementioned preferred embodiment, the rotation speed control of the centrifugal fan 5 can be accurately performed on the basis of the primary-side pressure P1 detected by the primary-side pressure detection tube 81*a* as described above.

Moreover, similarly to the aforementioned preferred embodiment, when seen from the direction along the rotary shaft 52 (the rotational axis A) (herein, the bottom surface side), the primary-side pressure detection tube 81*a* is herein opened in a position close to a corner of the circumferential part of the casing (see FIG. 14). With the construction, the primary-side pressure detection tube 81*a* is herein opened in a position more unlikely to be affected by dynamic pressure in the vicinity of the fan opening 55*a* on the inlet side surface of the bell mouth 33. Consequently, the primary-side pressure P1 of the centrifugal fan 5 can be herein more accurately detected.

On the other hand, although herein not shown in the drawings, it is also possible in a ceiling suspended type air conditioning apparatus to dispose the primary-side pressure detection tube 81*a* of the pressure sensor in a position similarly to that of FIGS. 13 and 14.

The invention claimed is:

1. An air conditioning apparatus, comprising:

a centrifugal fan mounted in an interior of a casing, the centrifugal fan including a bladed wheel having a hub, a shroud and a plurality of rearward blades, the hub being coupled to a rotary shaft of a fan motor, the shroud being opposed to the hub and having a fan opening bored in a center part thereof, the rearward blades being disposed between an outer peripheral part of the hub and an outer peripheral part of the shroud, a bell mouth inserted at an outlet end thereof into the fan entrance; and a pressure sensor having a primary-side pressure detection tube opened in a position adjacent to a circumferential part of the casing on an inlet side of the bell mouth when the bell mouth is seen from a direction along the rotary shaft to detect a primary-side pressure of the centrifugal fan, the position where the primary-side detection tube is opened being closer to the circumferential part of the casing than to the fan opening when seen from the direction along the rotary shaft, and the position where the primary-side detection tube is opened being aligned with the bell mouth when seen along a direction perpendicular to the direction along the rotary shaft.

2. The air conditioning apparatus according to claim 1, wherein the primary-side pressure detection tube is opened in a position adjacent to a corner of the circumferential part of the casing when seen from the direction along the rotary shaft.

3. An air conditioning apparatus, comprising:

a casing having an intake port and a blow-out port;

a partition member dividing an interior of the casing into a heat exchanger compartment located on an intake port side and a fan compartment located on a blow-out port side, the partition member having a fan entrance, the fan entrance making the heat exchanger compartment and the fan compartment communicate with each other;

a heat exchanger mounted in the heat exchanger compartment;

a centrifugal fan including a bladed wheel having a plurality of rearward blades, the centrifugal fan being configured to suck air existing in the heat exchanger compartment into the fan compartment through the fan entrance, with the bladed wheel being mounted in the fan compartment such that a rotary shaft of the bladed wheel is oriented along an opening direction of the fan entrance; and a primary pressure sensor having a primary-side pressure detection tube opened in a position adjacent to a circumferential part of the casing on a heat exchanger compartment side of the partition member when the partition member is seen from a direction along the rotary shaft to detect a primary-side pressure of the centrifugal fan, the position where the primary-side detection tube is opened being closer to the circumferential part of the casing than to the fan entrance of the partition member when seen from the direction alone the rotary shaft, and the position where the primary-side detection tube is opened being closer to the partition member than to the heat exchanger as measured along the direction along the rotary shaft.

4. The air conditioning apparatus according to claim 3, wherein the primary pressure sensor is disposed on a fan compartment side of the partition member, and the primary-side pressure detection tube extends from the primary pressure sensor to the partition member along lateral parts forming the circumferential part of the casing when seen from the direction along the rotary shaft.

5. The air conditioning apparatus according to claim 4, wherein the rotary shaft of the bladed wheel is disposed in a position adjacent to a bladed wheel nearby lateral part, the bladed wheel nearby lateral part being one of the lateral parts of the casing that are disposed along the opening direction of the fan entrance, and the primary-side pressure detection tube is opened in a position adjacent to another one of the lateral parts of the casing, the another lateral part being opposed to the bladed wheel nearby lateral part.

6. The air conditioning apparatus according to claim 4, further comprising a secondary pressure sensor having a secondary-side pressure detection tube opened in the fan compartment to detect a secondary-side pressure of the centrifugal fan, the air conditioning apparatus being configured to perform rotation speed control of the centrifugal fan based on a pressure differential between the secondary-side pressure and the primary-side pressure.

7. The air conditioning apparatus according to claim 3, wherein the rotary shaft of the bladed wheel is disposed in a position adjacent to a bladed wheel nearby lateral part, the bladed wheel nearby lateral part being one of multiple lateral parts of the casing that are disposed along the opening direction of the fan entrance, and the primary-side pressure detection tube is opened in a position adjacent to another one of the multiple lateral parts of the casing, the another lateral part being opposed to the bladed wheel nearby lateral part.

8. The air conditioning apparatus according to claim 7, further comprising a secondary pressure sensor having a secondary-side pressure detection tube opened in the fan compartment to detect a secondary-side pressure of the centrifugal fan, the air conditioning apparatus being configured to perform rotation speed control of the centrifugal fan based on a pressure differential between the secondary-side pressure and the primary-side pressure.

9. The air conditioning apparatus according to claim 3, further comprising a secondary pressure sensor having a secondary-side pressure detection tube opened in the fan compartment to detect a secondary-side pressure of the centrifugal fan, the air conditioning apparatus being configured to perform rotation speed control of the centrifugal fan based on a pressure differential between the secondary-side pressure and the primary-side pressure.

10. The air conditioning, apparatus according to claim 3, wherein the primary-side pressure detection tube is opened in a position adjacent to a corner of the circumferential part of the casing when seen from the direction along the rotary shaft.

* * * * *